US011104551B2

(12) United States Patent
Kollmey

(10) Patent No.: US 11,104,551 B2
(45) Date of Patent: Aug. 31, 2021

(54) ESCALATOR

(71) Applicants: Michael Kollmey, Neuss (DE); Birgit Struve, Wuppertal (DE); Antje Proske, Sinsheim (DE); Christine Mahn, Weisdin (DE); Katrin Weste, Bergkamen (DE)

(72) Inventor: Horst Kollmey

(73) Assignees: Michael Kollmey, Neuss (DE); Birgit Struve, Wuppertal (DE); Antje Proske, Sinsheim (DE); Christine Mahn, Weisdin (DE); Katrin Weste, Bergkamen (DE)

( * ) Notice: Subject to any disclaimer, the term of this patent is extended or adjusted under 35 U.S.C. 154(b) by 0 days.

(21) Appl. No.: 16/611,857

(22) PCT Filed: Apr. 27, 2018

(86) PCT No.: PCT/EP2018/000225
§ 371 (c)(1),
(2) Date: Nov. 8, 2019

(87) PCT Pub. No.: WO2018/206140
PCT Pub. Date: Nov. 15, 2018

(65) Prior Publication Data

US 2021/0147186 A1 May 20, 2021

(30) Foreign Application Priority Data

May 11, 2017 (DE) ..... 10 2017 004 507.0

(51) Int. Cl.
*B66B 23/14* (2006.01)
*B66B 23/12* (2006.01)
*B66B 23/02* (2006.01)

(52) U.S. Cl.
CPC ..... *B66B 23/147* (2013.01); *B66B 23/12* (2013.01); *B66B 23/024* (2013.01); *B66B 23/026* (2013.01); *B66B 23/145* (2013.01)

(58) Field of Classification Search
CPC ..... B66B 23/08; B66B 23/14; B66B 23/145; B66B 23/147; B66B 21/04; B66B 23/12
(Continued)

(56) References Cited

U.S. PATENT DOCUMENTS 1,138,100 A * 5/1915 Gale, Jr. ..... B66B 21/025 198/322
1,445,588 A * 2/1923 Hendry ..... B66B 21/04 198/332

(Continued)

FOREIGN PATENT DOCUMENTS

DE 10 2005 039 755 B3 1/2007
DE 10 2005 058 052 A1 6/2007

(Continued)

*Primary Examiner* — James R Bidwell
(74) *Attorney, Agent, or Firm* — Norman B. Thot

(57) ABSTRACT

An escalator includes movable step segments. Each step segment includes a rectangular step plate with a constant height, a tread, and four corners. The tread of each step segment is in a horizontal position during a front transport movement and in an oblique position during a rear return movement. Four wheels which include two front wheels and two rear wheels are assigned to each step segment, with one wheel being mounted at each of the four corners. Two endless transport chains transport the two front wheels at a front transport section. Two first tracks have the two rear wheels run thereon without being attached to any of the two endless transport chains. Two rear second transport tracks are arranged in a rear return transport section. The two rear second transport tracks transport each step segment back with the tread in an oblique position via the two endless transport chains.

10 Claims, 2 Drawing Sheets

(58) Field of Classification Search
USPC ..... 198/321, 322, 326, 327
See application file for complete search history.

(56) References Cited

U.S. PATENT DOCUMENTS

| | | | | |
|---|---|---|---|---|
| 6,832,678 | B2 * | 12/2004 | Ogura | B66B 21/025 198/322 |
| 8,967,364 | B2 * | 3/2015 | Kleine-Bruggeney | B66B 23/12 198/333 |
| 2015/0284217 | A1 * | 10/2015 | Park | B66B 21/10 198/321 |
| 2017/0197809 | A1 * | 7/2017 | Matheisl | B66B 29/005 |

FOREIGN PATENT DOCUMENTS

| | | | |
|---|---|---|---|
| DE | 20 2007 003 908 | U1 | 6/2007 |
| DE | 10 2005 058 051 | B3 | 7/2007 |
| EP | 1 072 552 | A1 | 1/2001 |
| GB | 197744 | A | 5/1923 |
| JP | 2003-292276 | A | 10/2003 |
| WO | WO 99/52808 | A1 | 10/1999 |

* cited by examiner

ESCALATOR

CROSS REFERENCE TO PRIOR APPLICATIONS

This application is a U.S. National Phase application under 35 U.S.C. § 371 of International Application No. PCT/EP2018/000225, filed on Apr. 27, 2018 and which claims benefit to German Patent Application No. 10 2017 004 507.0, filed on May 11, 2017. The International Application was published in German on Nov. 15, 2018 as WO 2018/206140 A1 under PCT Article 21(2).

FIELD

The present invention relates to an escalator comprising a serial assembly of a plurality of movable step segments each of which runs on four wheels mounted at the four corners of each step segment, the tread of each step segment being in a horizontal position during the front transport movement and in an oblique position during the rear return movement.

BACKGROUND

JP 2003292276A describes an escalator which has step segments comprising a plurality of profiles that are linked with each other, wherein both the front rollers/wheels of the step segments are attached to a transport chain and the rear rollers/wheels of the step segments are attached to another transport chain. Such an escalator design is technically complex and has the additional disadvantage that typical escalators also exhibit, namely, that it requires an installation space having a great depth at both the bottom end section (bottom reversing station) and at the top end section (upper reversing station). An installation of this type of escalator is therefore not possible if only an installation space having a low depth is available at the bottom and/or at the top end section.

SUMMARY

An aspect of the present invention is to improve on an escalator of this kind so that, with a simple design and with a long useful life, an installation space of low height at both end sections is required.

In an embodiment, the present invention provides an escalator which includes a serial assembly of a plurality of movable step segments. Each of the plurality of movable step segments comprises a rectangular step plate having a constant height, a tread, and four corners. The tread of each of the plurality of step segments is in a horizontal position during a front transport movement and in an oblique position during a rear return movement. Four wheels comprising two front wheels and two rear wheels are assigned to each of the plurality of movable step segments, with one of the four wheels being mounted at one of the four corners. Two endless transport chains are configured to transport the two front wheels at a front transport section. Two first tracks are configured to have the two rear wheels run thereon without being attached to any of the two endless transport chains. Two rear second transport tracks are arranged in a rear return transport section. The two rear second transport tracks are configured to transport each of the plurality of movable step segments back with the tread in an oblique position via the two endless transport chains

BRIEF DESCRIPTION OF THE DRAWINGS

The present invention is described in greater detail below on the basis of embodiments and of the drawings in which.

DETAILED DESCRIPTION

Figure 1:
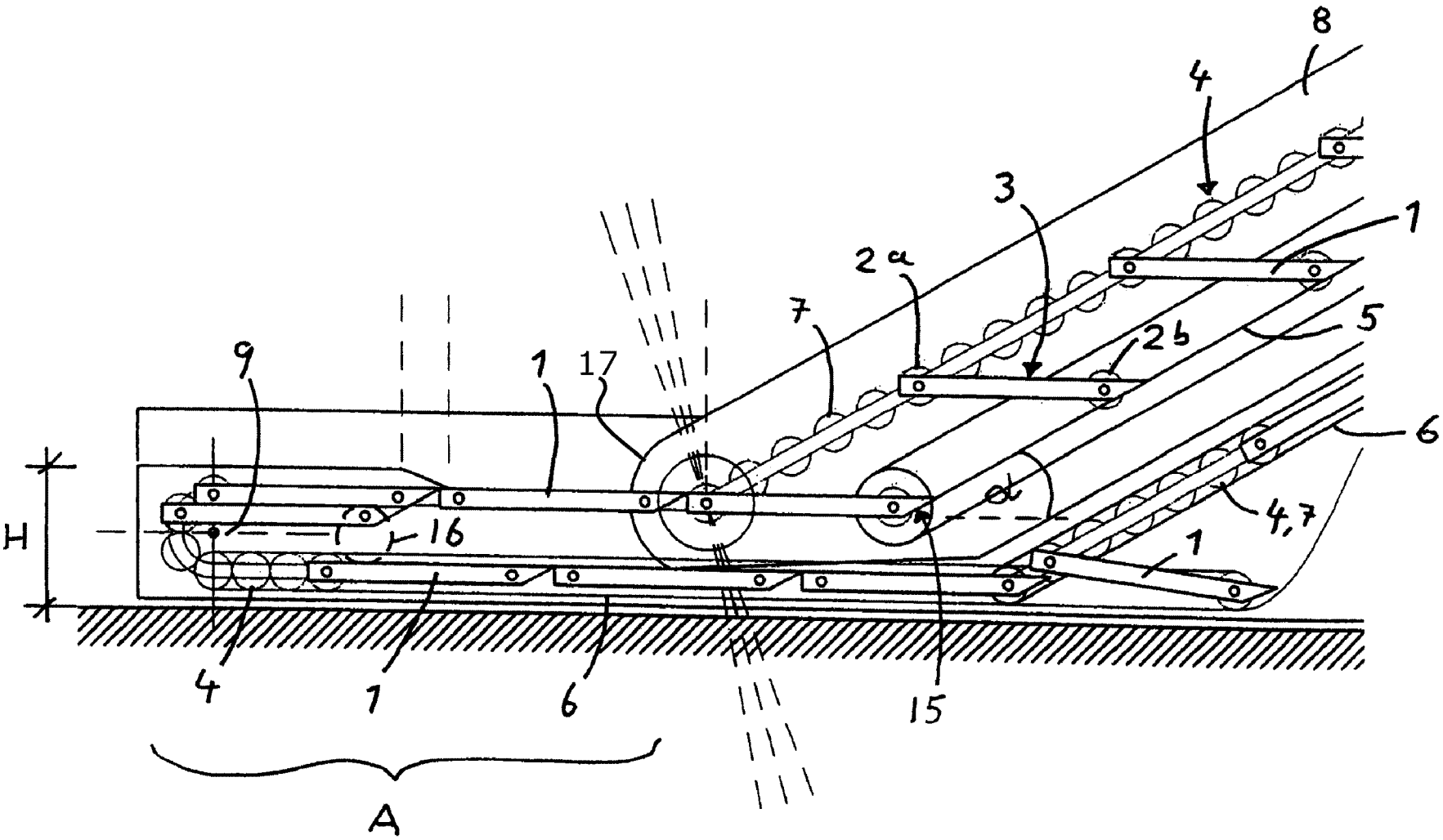
FIG. 1 shows the lower section of the escalator of the present invention.
Figure 2:
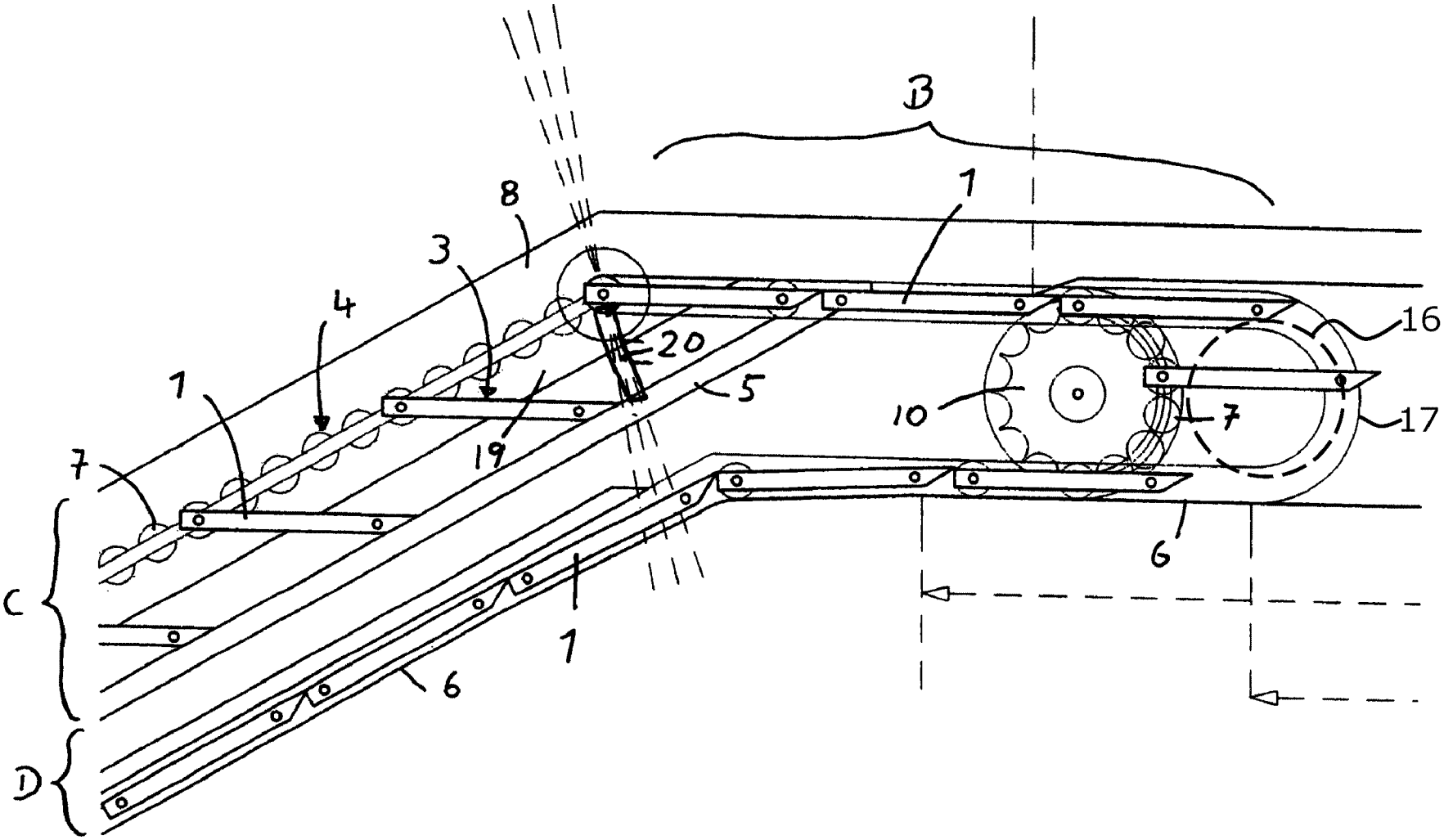
FIG. 2 shows the upper section of the escalator of the present invention.

In an embodiment, the present invention provides that:

- each step segment is formed by a rectangular step plate of constant height with one wheel mounted at each of the four corners thereof,
- in the front transport section of the escalator, the front two wheels of each step segment are transported by two endless transport chains,
- the rear two wheels of each step segment run on two oblique first tracks without being attached to transport chains, and
- in the rear return transport section, the step segments are transported back with the tread in an oblique position by the two endless transport chains on two oblique, rear, second tracks.

Such an execution not only results in a simple design and in a long useful life, but also permits an especially low overall height of the escalator in the bottom as well as in the top end section so that such an escalator can also be installed and used in places were an installation space only having a shallow depth is available.

Previously described escalators have such an overall height that they require pits of a great depth or step-on and/or step-off aids to permit boarding the escalator or landing.

The escalator according to the present invention constructs the bottom reversing station with such a low overall height that it can be readily stepped on. The frame of the elevator is executed as a composite construction of several beams with tracks and locking devices arranged on the frame.

The proposed improvement for the first time provides a location-independent continuous escalator and a more streamlined overall appearance, in particular of the bottom, extremely flat reversing station, and also provides the benefit of adaptability to various or changing heights of the upper reversing station. Apart from a stationary use, this also permits for a mobile use at airports, at docks, at trade fair grounds, etc. and provides the advantage of a convenient bridging of great heights and the possibility of lowering the platform for the transportation and parking at the destination. For installation in smaller buildings, the escalator of the present invention offers the advantage of requiring a shallow pit. In all fields of application, the escalator permits an adaptation to specified or changing heights down to the last millimeter even during the cycling of the steps in their loop.

These stated advantages are also achieved because in the bottom and top end sections, the step segments are in a horizontal position in the front and rear transport sections while they are being transported horizontally on horizontal tracks.

In an embodiment of the present invention, the two transport chains can, for example, have chain links in the form of rollers with a diameter that equals the diameter of the wheels of the step segments.

It is also advantageous if the axles of the wheels of each step segment are arranged below the tread.

In an embodiment of the present invention, the transport chains and the tracks can, for example, be arranged in lateral stringers of the escalator.

It is also advantageous if the transport chains are reversed by sprocket wheels in the bottom and top end sections of the escalator.

It is also proposed that in the top and bottom end sections of the escalator, the step segments be guided horizontally and thus form horizontal boarding and landing areas with their treads.

A safe transport and a safe guidance of the individual step segments are achieved if the rear end of each step segment is beveled at an angle that is the same as the inclination angle of the escalator.

The stability of the escalator is greatly improved if the two lateral stringers of the escalator are connected with each other by U-shaped girders that at the same time are closures of the tread overhang (nosing) areas.

It is also advantageous if two additional reversing wheels are mounted in the bottom end section, via which the rear wheels of the step segments are reversed so that a safe reversing movement of the individual step segments is provided.

Feet/shoes getting caught is substantially avoided if in the bottommost and/or topmost gap (tread overhang area) between the step segments, movable sliders are guided which cover the rear area of the gap while the height of the gap decreases.

An embodiment of the present invention is shown in the drawings and is described in greater detail below.

The escalator has a plurality of step segments 1 each of which is formed by a rectangular step plate having a constant low height. The upper side of the step segment is formed by a tread 3, and at each of the four corners, a wheel 2 is mounted with the axle arranged below the tread 3. The front two wheels 2*a* are each attached to a transport chain 4 which is formed by a roller chain having rollers 7. The rear two wheels 2*b* of the step segments 1 run on first oblique tracks 5 and are not attached to a chain.

In the front transport section C, the step segments 1 with their step plate and tread 3 are in a horizontal position, while in the rear return transport section D, the step plates and the treads 3 are in an oblique position. In the oblique position, the step segments 1 run with its four wheels 2*a*, 2*b* on rear second tracks 6.

The rear ends 15 of the step segments 1 are beveled at an angle $\alpha$ which corresponds to the inclination angle of the escalator so that a safe guidance of the step segments in the first oblique track 5 is provided.

Both in the bottom end section (bottom reversing station) A and in the top end section (top reversing station) B, the two lateral transport chains 4 run horizontally so that the step segments 1 are guided horizontally in these sections, also because the tracks 5, 6 are likewise horizontal in these sections. The transport chains 4 are reversed by sprocket wheels 9, 10 at the two outer ends of both end sections A, B.

With such a design, the end sections A, B, in particular the bottom end section A, can be constructed with a low distance between the upper and lower step segments 1 so that the escalator can have a low overall height H in the end sections.

Reversing wheels 16 are also arranged in the two end sections A, B which take up the rear wheels 2*b* while the respective step segment 1 is reversed or turned around.

On either side of the escalator, there is a stringer 8 which accommodates the transport chains and the tracks 5, 6. The stringers 8 are connected with one another by U-shaped girders (not shown in the drawings) which serve to improve the stability and in addition are closures of the tread overhang areas 19.

When a step segment 1 approaches the end section (A or B), the distance between the step segment 1 and the adjoining step segment 1 decreases, i.e., the gap between the two step segments (referred to as "tread overhang area" 19) becomes smaller. As a consequence, the foot/shoe of a person riding the elevator may be caught in this tread overhang area. To prevent this, a horizontally movable slider 20 is provided in the tread overhang area which clears the tread overhang area while the gap becomes smaller.

The step plates are grooved on the surface and at the front and rear side and are angular or rounded at the edges. They are connected with the bearing and pulling devices of the step link band and correspond with their rear bevel with all closing devices. They may exhibit penetrations, divisions, cuts or inclusions etc. but no exceedance of their fundamentally flat cuboid contour.

The reversing stations A and B are equipped with the supports for the escalator frame, with the drive for the step link band and with the movable or immovable locking devices arranged in the pit for the protection of persons and objects, as well as with devices for tensioning the chains, for reversing the step link band, for the roller tracks bent inside and for the transfers of the step link band at the interfaces of the assemblies. They may be equipped with an additional drive with an additional drive shaft.

The reversing station cover is executed with a downward crank in the pit. Brush strips, dimple tapes and saddle tapes seal the slots of the tracks and/or the lug bolts of the step link band and the rear sprocket wheel. The handrail is equipped with a dimple protection below the gripping area and can be provided with a sanitizing device.

The body may exhibit devices for cleaning, for creating a pressure above the atmospheric pressure, for cooling or heating or other protection or safety devices.

The present invention is not limited to embodiments described herein; reference should be had to the appended claims.

What is claimed is:

1. An escalator comprising:

a serial assembly of a plurality of movable step segments, each of the plurality of movable step segments comprising a rectangular step plate having a constant height, a tread, and four corners, the tread of each of the plurality of step segments being in a horizontal position during a front transport movement and in an oblique position during a rear return movement;

four wheels comprising two front wheels and two rear wheels which are assigned to each of the plurality of movable step segments, with one of the four wheels being mounted at one of the four corners;

two endless transport chains which are configured to transport the two front wheels at a front transport section;

two first tracks which are configured to have the two rear wheels run thereon without being attached to any of the two endless transport chains;

two rear second transport tracks arranged in a rear return transport section, the two rear second transport tracks being configured to transport each of the plurality of movable step segments back with the tread in an oblique position via the two endless transport chains; and movable sliders arranged in at least one of a bottommost gap and in a topmost gap between the plurality of step segments, the movable sliders being guided so as to cover a rear area of the bottommost gap and/or the topmost gap while a height of the bottommost gap and/or the topmost gap decreases.

2. The escalator as recited in claim 1, further comprising:

a top section; and a bottom section, wherein, in the top section and in the bottom section, the plurality of movable step segments are in a horizontal position in the front transport section and in the rear return transport section while being transported horizontally on the two first tracks and on the two rear second transport tracks.

3. The escalator as recited in claim 1, wherein each of the two endless transport chains comprise chain links in the form of rollers which have a diameter that equals a diameter of the four wheels assigned to each of the plurality of movable step segments.

4. The escalator as recited in claim 1, wherein an axis of each of the four wheels which are assigned each of the plurality of moveable step segments is arranged below the tread.

5. The escalator as recited in claim 1, further comprising:

two lateral stringers, wherein, one of the two endless transport chains, one of the two first tracks, and one of the two rear second transport tracks are each respectively arranged in one of the two lateral stringers.

6. The escalator as recited in claim 5, further comprising:

U-shaped girders which are configured to connect the two lateral stringers with each other and to close an overhang area of the tread of the plurality of movable step segments.

7. The escalator as recited in claim 1, further comprising:

sprocket wheels arranged at a top end section of the escalator; and sprocket wheels arranged at a bottom end section of the escalator, wherein, the sprocket wheels are configured to reverse the two endless transport chains in the bottom end section and in the top end section.

8. The escalator as recited in claim 7, wherein, in the top end section and in the bottom end section, the plurality of step segments are guided horizontally so as to form, via the tread of each of the plurality of step segments, a horizontal boarding area and a horizontal landing area.

9. The escalator as recited in claim 7, further comprising:

two reversing wheels mounted in the bottom end section, the two reversing wheels being configured to reverse the plurality of step segments.

10. The escalator as recited in claim 1, wherein, the escalator is arranged to have an inclination angle, and each of the plurality of movable step segments further comprises a rear area which is beveled at an angle which is equal to the inclination angle.

* * * * *